United States Patent [19]

Evans et al.

[11] Patent Number: 4,522,004

[45] Date of Patent: Jun. 11, 1985

[54] INSULATED WALL CONSTRUCTION

[75] Inventors: Michael E. Evans; Bradley W. Oberg, both of Granville, Ohio

[73] Assignee: Owens-Corning Fiberglas Corporation, Toledo, Ohio

[21] Appl. No.: 505,145

[22] Filed: Jun. 16, 1983

[51] Int. Cl.[3] ..... E04B 2/08

[52] U.S. Cl. ..... 52/409; 52/416; 52/417; 52/454

[58] Field of Search ..... 52/409, 416, 417, 443, 52/444, 447, 448, 449, 453, 454, 452

[56] References Cited

U.S. PATENT DOCUMENTS

| | | | |
|---|---|---|---|
| 783,544 | 2/1905 | Roberts | 52/443 |
| 1,116,202 | 11/1914 | Assip | 52/454 |
| 1,744,354 | 1/1930 | Beaty | 52/452 |
| 2,078,049 | 4/1937 | Benedict | 52/417 |
| 2,120,644 | 6/1938 | Harper | 52/447 |
| 4,191,001 | 3/1980 | L'Heureux | 52/743 |

FOREIGN PATENT DOCUMENTS

| | | | |
|---|---|---|---|
| 2614529 | 10/1977 | Fed. Rep. of Germany | 52/409 |
| 2842879 | 4/1980 | Fed. Rep. of Germany | 52/444 |
| 1015705 | 1/1966 | United Kingdom | 52/409 |

*Primary Examiner*—Henry E. Raduazo
*Assistant Examiner*—Caroline Dennison
*Attorney, Agent, or Firm*—Ronald C. Hudgens; Ted C. Gillespie; Paul J. Rose

[57] ABSTRACT

An exterior insulation system for walls including a fibrous insulation board having a scrim adhered thereto on an outer side and having shiplap-type vertical edges, and cementitious material applied over the scrim.

8 Claims, 6 Drawing Figures

INSULATED WALL CONSTRUCTION

TECHNICAL FIELD

This invention relates generally to insulation of outside walls of buildings, and more particularly to an external insulation system for existing buildings, although it is also applicable to new building construction.

BACKGROUND ART

U.S. Pat. No. 4,191,001 discloses a method of exteriorly insulating existing concrete block walls by applying furring strips, expanded polystyrene boards over the furring strips, chicken wire stapled to the polystyrene boards, and a concrete coating over the chicken wire and polystyrene boards. The butt joints between boards are sealed with a polystyrene glue. The stapling of the chicken wire and the glueing of the butt joints is relatively time-consuming. Further, the polystyrene board has a relatively high coefficient of thermal expansion. For this reason, the board is frequently applied in relatively small pieces, such as two by four feet, and this requires sealing more joints as well as cutting and putting up more pieces. Also, the concrete coating must have an elastomeric bonding agent to compensate for thermal expansion and contraction of the board. In addition, the polystyrene board encounters resistance by enforcers of fire codes.

DISCLOSURE OF THE INVENTION

In accordance with the invention, fibrous insulation boards are provided which have a scrim adhered thereto in the factory, with a loose flap at one edge which becomes a vertical edge when a board is mounted. In addition, the opposite vertical edges are rabbeted respectively on opposite sides of the board to provide a shiplap-type joint between adjacent boards. Fasteners are provided for holding the scrim as well as the boards. Furring strips, stapling of chicken wire, and glueing of butt joints are eliminated, and the completed installation is more durable. The insulation boards have a relatively low coefficient of thermal expansion, can be applied in four-by-eight foot sheets, and readily pass fire code requirements.

BRIEF DESCRIPTION OF DRAWINGS

The invention is more fully explained hereinafter with reference to the accompanying drawings wherein.

BEST MODE OF CARRYING OUT THE INVENTION

With reference to the drawings, fibrous insulation boards 10 constructed in accordance with the invention are shown in FIGS. 1 to 6. The boards 10 are preferably glass fiber boards having a density of about four pounds per cubic foot and consisting essentially of glass fibers impregnated with about thirteen percent by weight of a binder such as phenol-urea-formaldehyde resin. Opposite vertical edge portions of each board are rabbeted respectively on opposite sides of the board to provide a shiplap-type joint between adjacent mounted boards, as can be seen most clearly in FIGS. 3 and 4. Each board 10 is preferably at least 1 inch thick and has a scrim 12, preferably woven glass fiber, adhesively secured to the side thereof which faces outwardly of a building when the board is mounted. The scrim 12 is flush with one edge portion of a board 10 but has a flap 12*a* (FIG. 3) at the other edge portion of the board for overlapping a joint between adjacent mounted boards. Preferably, the scrim 12 has about six by six strands per square inch and is either made of alkali resistant glass or coated with a protective coating such as polyvinylchloride resin.

Figure 2:
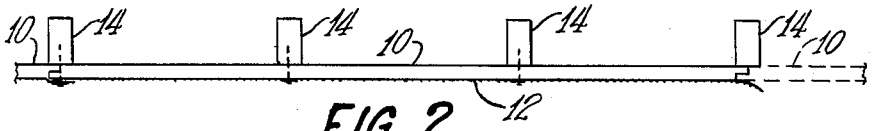
FIG. 2 is a plan view of the structure of FIG. 1.
Figure 1:
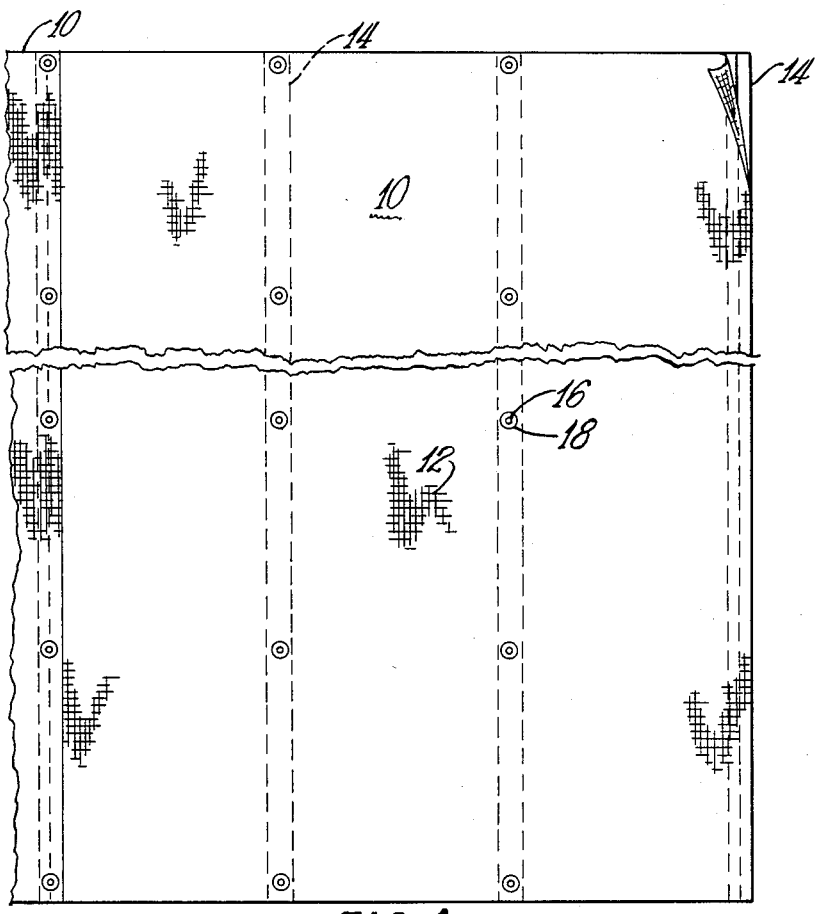
FIG. 1 is an elevational view of a fibrous insulation board faced with a scrim in accordance with the invention, mounted on studding.
Figure 3:
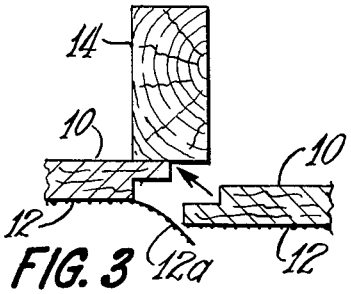
FIG. 3 is a plan view showing the formation of a joint between two fibrous insulation boards constructed in accordance with the invention.
Figure 4:
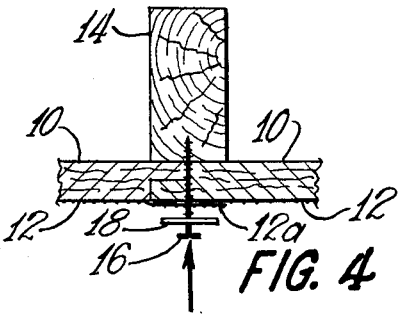
FIG. 4 is a plan view similar to FIG. 3, but with both insulation boards in place.
Figure 5:
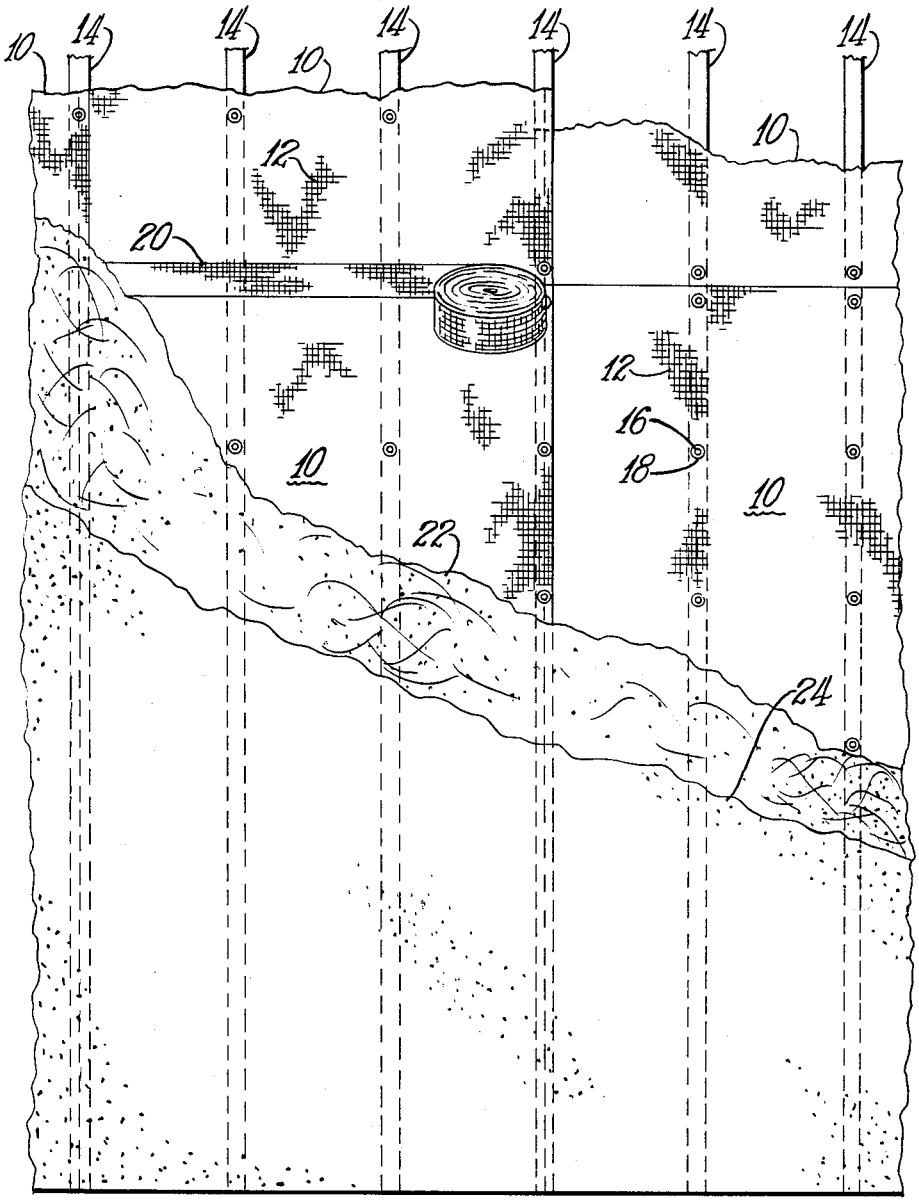
FIG. 5 is an elevational view similar to FIG. 1, but illustrating further steps in the construction of a wall.

In FIGS. 1 to 5, the boards 10 are shown secured to wooden studs 14 by suitable mechanical fasteners 16 having large washers 18 respectively thereon, as best shown in FIG. 4. Alternatively, staples could be used without washers. The studs 14 could be metal studs for use with self-drilling screws as fasteners. At each vertical joint between two boards 10, the washers 18 tightly secure the scrim 12 of the two boards. The boards 10 can be vertically stacked for heights greater than eight feet, as shown in FIG. 5. Horizontal butt joints between boards 10 are covered with pressure sensitive adhesive tape 20 which also includes a glass scrim similar to the scrim 12.

A cementitious coat 22 (FIG. 5) is troweled over the scrim 12 and boards 10, and a finish coat 24 is troweled over the coat 22. Any suitable insulating material may be installed between pairs of adjacent studs 14, and suitable panels or drywall may be installed on the inner side of the structural wall formed by the studs 14.

Figure 6:
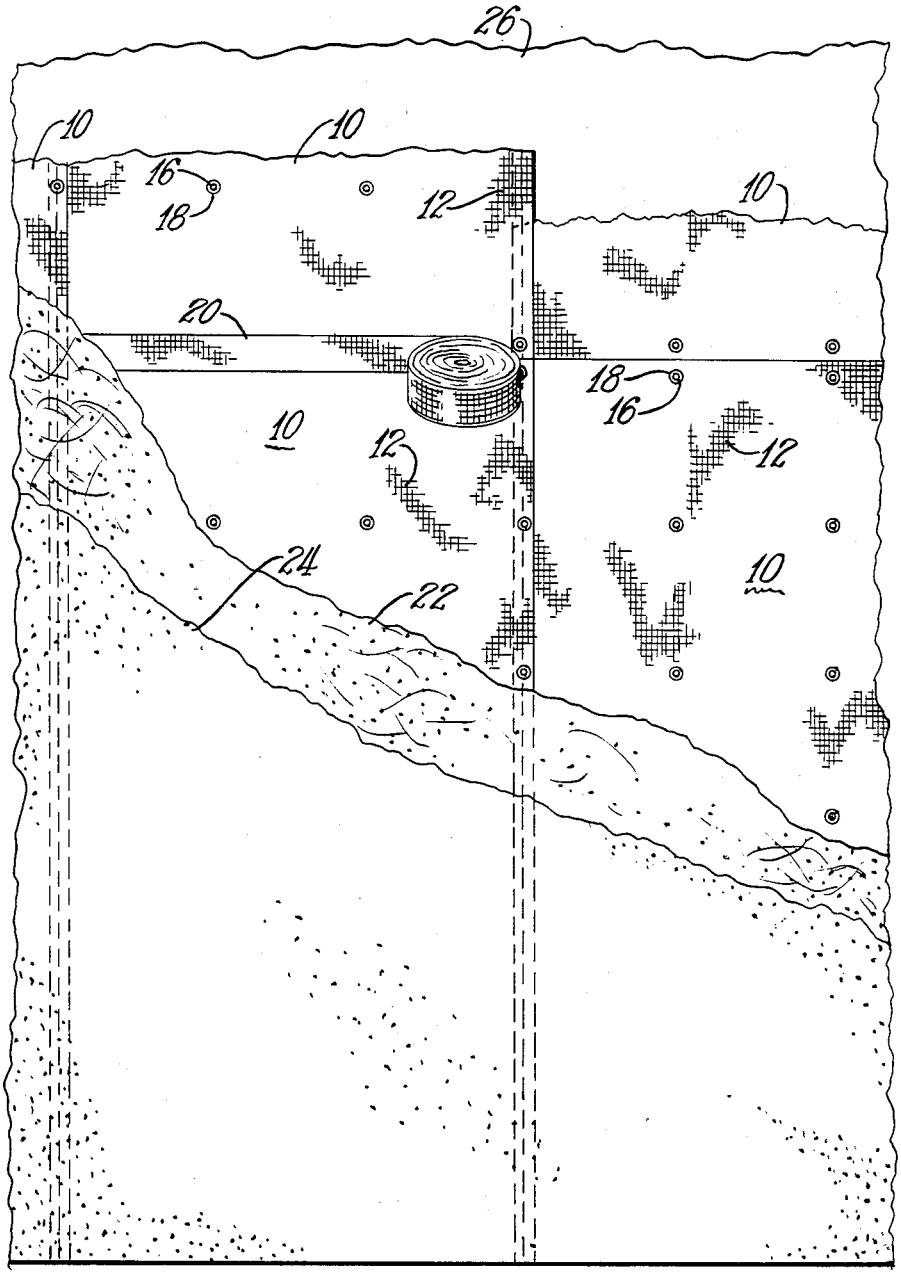
FIG. 6 is a view similar to FIG. 5, but with the studding replaced by a masonry wall.

FIG. 6 is a view similar to FIG. 5, except that a masonry wall 26, which may be poured concrete, concrete blocks, or bricks, has been used as the mounting structure or structural wall instead of the studs 14.

It will be noted that the wall 26 or the studs 14 can be part of either a new construction or an existing building.

Various modifications can be made in the structure shown and described without departing from the spirit and scope of the invention.

We claim:

1. An insulated outer wall construction for a building, said wall construction comprising a structural outer wall, a plurality of elongated rectangular fibrous glass insulation boards mounted, with longer edges extending vertically, in covering relationship to said outer wall on a side thereof facing outwardly of the building, each of said boards being devoid of a vapor barrier and having a scrim adhesively secured thereto on an outer side thereof, the scrim including a flap along one vertical edge of the board overlapping a joint between the board and an adjacent board, fastening means mechanically securing said boards and scrim to said outer wall, and a coat of cementitious material covering said boards, scrim, and fastening means.

2. A wall construction as claimed in claim 1 wherein the scrim is woven glass fiber scrim.

3. For use particularly in retrofit exterior insulation systems for outer walls of existing buildings, a fibrous glass insulation board approximately four feet wide and eight feet high in a mounted position with opposite vertical edge portions rabbeted respectively on opposite sides of the board to provide shiplap-type joints respectively with adjacent mounted boards, the board being devoid of a vapor barrier and having a scrim adhesively secured thereto on an outer side thereof, the scrim including a flap along one vertical edge of the board for overlapping a joint between the board and an adjacent mounted board.

4. An insulation board as claimed in claim 3 wherein the scrim is glass fiber scrim.

5. A wall construction as claimed in claim 1 wherein the fibrous glass insulation boards have a density of about four pounds per cubic foot.

6. A wall construction as claimed in claim 1 wherein the fibrous glass insulation boards comprise glass fibers impregnated with about thirteen percent by weight of a resin binder.

7. A fibrous glass insulation board as claimed in claim 3, the board having a density of about four pounds per cubic foot.

8. A fibrous glass insulation board as claimed in claim 3, the board comprising glass fibers impregnated with about thirteen percent by weight of a resin binder.

* * * * *